United States Patent [19]

Kuhn

[11] 4,151,974

[45] May 1, 1979

[54] ANCHOR

[76] Inventor: Charles J. Kuhn, 10520 Plainview Ave., Tujunga, Calif. 91042

[21] Appl. No.: 815,253

[22] Filed: Jul. 13, 1977

Related U.S. Application Data

[63] Continuation-in-part of Ser. No. 727,956, Sep. 29, 1976, abandoned.

[51] Int. Cl.[2] ..... E02D 5/80

[52] U.S. Cl. ..... 248/499; 52/160; 52/704; 85/67; 85/74; 403/290; 105/483

[58] Field of Search ..... 52/704, 709, 711, 160; 105/483, 484, 485, 475; 403/348, 349, 290; 248/499; 85/74, 75, 5 P, 67, 76, 69, 73; 151/41.74; 294/89, 94, 96

[56] References Cited

U.S. PATENT DOCUMENTS

| | | | |
|---|---|---|---|
| 822,769 | 6/1906 | Quist | 294/89 |
| 1,102,079 | 6/1914 | Rizer | 403/348 X |
| 2,120,577 | 6/1938 | Schulte | 85/75 |
| 2,139,167 | 12/1938 | Marshall | 85/69 X |
| 2,403,541 | 7/1946 | Molat | 52/711 |
| 2,719,747 | 10/1955 | Layne | 294/89 |
| 3,106,377 | 10/1963 | Cotton | 105/485 |
| 3,124,385 | 3/1964 | Neptune | 52/711 X |
| 3,201,166 | 8/1965 | Boutin | 403/290 X |
| 3,367,620 | 2/1968 | Holt | 403/348 X |
| 3,404,504 | 10/1968 | Taylor | 52/711 X |
| 3,494,587 | 2/1970 | Kuhn | 248/499 |
| 3,550,343 | 12/1970 | Buske | 52/704 |
| 3,990,207 | 11/1976 | Eck et al. | 52/704 |
| 3,992,919 | 11/1976 | Jarmane | 85/5 P X |

FOREIGN PATENT DOCUMENTS

| | | | |
|---|---|---|---|
| 1560445 | 2/1969 | France | 85/75 |
| 139751 | 11/1920 | United Kingdom | 52/711 |
| 513176 | 5/1976 | U.S.S.R. | 85/67 |

*Primary Examiner*—Rodney H. Bonck

*Attorney, Agent, or Firm*—Christie, Parker & Hale

[57] ABSTRACT

An anchor for resisting a pulling force applied to a cable includes an expandable outer shell disposed in an opening in a floor, an outer wedge disposed in the shell and having wedge-shaped projections engaged with the inner wall of the shell, and a rotatable inner wedge below the outer wedge engaged with a short length of chain extending through the shell. A cable to be tensioned is attached to the short length of chain. Tension on the cable urges the inner wedge upwardly against the outer wedge which, in turn, is wedged in the interior of the shell to forceably expand the walls of the shell radially outwardly to embed the shell in the floor. The inner wedge is rotatable axially relative to the outer wedge between a first position, in which a wedging force is applied to the outer wedge in response to tensioning of the cable, and a second position, which allows removal of the inner wedge and the short length of chain from the outer wedge and the shell.

10 Claims, 10 Drawing Figures

Fig. 7
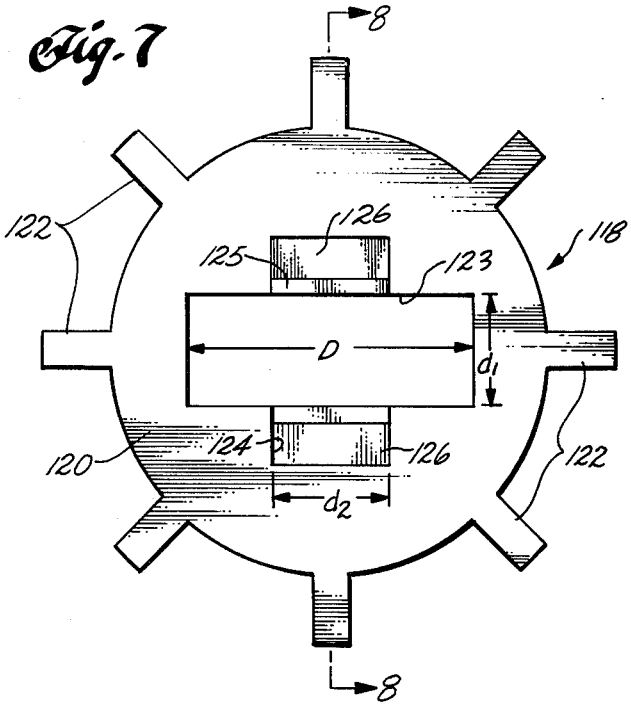
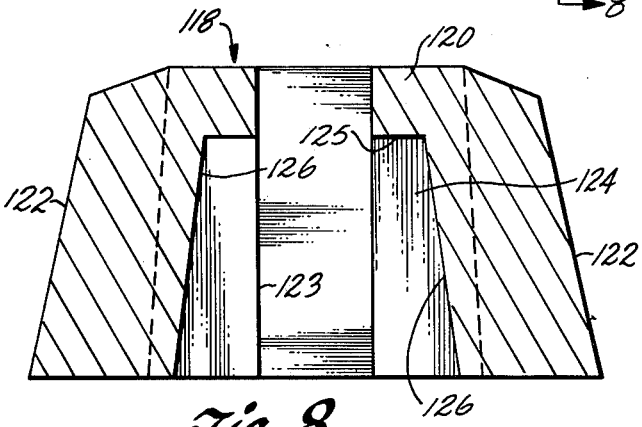
Fig. 8
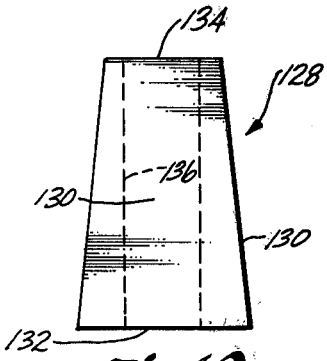
Fig. 10
Fig. 9
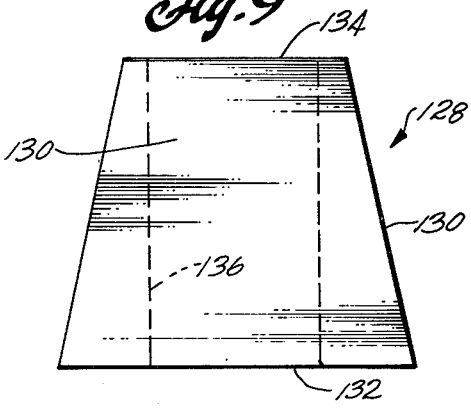

ANCHOR

CROSS-REFERENCE TO RELATED APPLICATION

This is a continuation-in-part of application Ser. No. 727,956, filed Sept. 29, 1976 now abandoned.

BACKGROUND

This invention relates to a tiedown apparatus or anchor, and more particularly to a composite anchor assembly which is especially useful in anchoring the ends of chains or cables used in straightening vehicle frames or the like. Although the anchor assembly is described in the context of its use in straightening frames, it can also be used in other applications requiring an anchor fixed to the ground, such as in anchoring heavy equipment to the floor, for example.

The present invention provides an improvement over the tiedown apparatus disclosed in my U.S. Pat. No. 3,494,587, which includes an outer shell disposed in an opening in a floor, a wedge member disposed in the shell, and a force-applying plate below the wedge. A short length of chain extends from a top cover plate to a point of attachment on the force-applying plate. A cable to be anchored is attached on the short length of chain. Tensioning of the cable pulls the force-applying plate upwardly to force the wedge member upwardly into the shell to expand the walls of the shell radially outwardly to embed the shell in the floor, providing a fixed anchor point for tension forces applied to the cable. This tiedown apparatus is especially useful when repairing frame damage to vehicles such as automobiles, in which one end of the vehicle frame is anchored by a chain or cable extending from the frame to the tiedown apparatus. A pulling force is applied to the opposite end of the frame against the resistance provided by the anchored cable or chain.

The present invention is based on a recognition that the tiedown apparatus disclosed in my patent has several disadvantages even though the tiedown apparatus, in recent years, has been adopted throughout the vehicle body repair industry.

For example, the wedge member is virtually impossible to remove once wedged in place in the outer shell. This make it virtually impossible to also remove the short length of chain and its attachment plate from the shell. The tiedown apparatus is prone to filling up with dirt and other corrosive matter which are difficult to remove from the shell. Since the chain and its force-applying plate cannot be easily removed from the shell, it is difficult to gain access to the interior of the shell to remove dirt. If the tiedown apparatus has been in place for a relatively long time, the wedge corrodes and often requires a cutting torch to remove the wedge from the shell so that the chain and its force-applying plate can be removed. Alternately, the outer shell must be removed by chipping away the concrete around the tiedown apparatus.

If the chain and its force-applying plate are not removed periodically, then the chain rusts and eventually breaks under the pulling forces applied to it. The inability to remove the chain also makes it virtually impossible to interchange chains of different weight with the tiedown apparatus. Thus, several tiedown devices of different sizes are commonly used to accommodate chains of different weight.

The structure of the patented tiedown apparatus also causes the tensioned chain to crush portions of the concrete floor surrounding the outer shell.

The present invention provides an anchor which overcomes the disadvantages of the patented tiedown apparatus described above. The present invention also is an improvement over tiedown apparatus disclosed in the following patents:

| U.S. Pat. No. | Patentee |
|---|---|
| 1,102,079 | Rizer |
| 2,120,577 | Schulte |
| 3,106,377 | Cotton |
| 3,124,385 | Neptune |
| 3,201,166 | Boutin |
| 3,367,620 | Holt |
| 3,404,504 | Taylor |
| 3,494,587 | Kuhn |
| 3,550,343 | Buske |
| 3,990,207 | Eck et al |
| 3,992,919 | Jarman |
| Foreign Patents | |
| Brit. 139,751 | Wagner |
| Fr. 1,560,445 | Bohan |

SUMMARY

Briefly, according to a presently preferred embodiment, the anchor of this invention includes a hollow outer shell having an expandable side wall, a hollow outer wedge disposed in the outer shell to engage the side wall of the shell, an inner wedge rotatable relative to the outer wedge between a first position and a second position, and means for being attached to a cable to be tensioned to urge the inner wedge against the outer wedge. The interior surface of the outer wedge has a first surface portion which is engaged by the inner wedge, in its first position, so that tension applied to the cable urges the inner wedge against the first surface portion of the outer wedge which, in turn, forceably expands the side wall of the shell to embed the shell in the floor. The interior surface of the outer wedge also has a second surface portion which is shaped to allow passage of the inner wedge and the cable-attachment means through the outer wedge when the inner wedge is rotated to its second postion. This allows the cable to be removed from the interior of the shell simply by releasing the inner wedge from engagement with the outer wedge, and then rotating the inner wedge to its second position to allow its removal along with the cable.

Thus, the inner wedge and the cable-attachment means can be removed easily from the wedged outer shell, which allows for frequent interchanging of a cable or chain housed in the shell. This avoids breakage of the chain due to rusting, and also allows chains of different weight to be quickly interchanged to facilitate anchoring against different levels of pulling force. The anchor facilitates frequent removal of dirt which collects in the shell, thereby prolonging the useful life of the anchor.

These and other aspects of the invention will be more fully understood by referring to the following detailed description and the accompanying drawings.

DRAWINGS

FIG. 7 is a bottom plan view taken on line 7—7 of FIG. 6 and showing an outer wedge of the alternate anchor assembly;

FIG. 8 is a cross-sectional view taken on line 8—8 of FIG. 7;

FIG. 9 is a front elevation view taken on line 9—9 of FIG. 6 and showing an inner wedge of the alternate anchor assembly; and FIG. 10 is an end elevation view taken on line 10—10 of FIG. 6.

DETAILED DESCRIPTION

Figure 1:
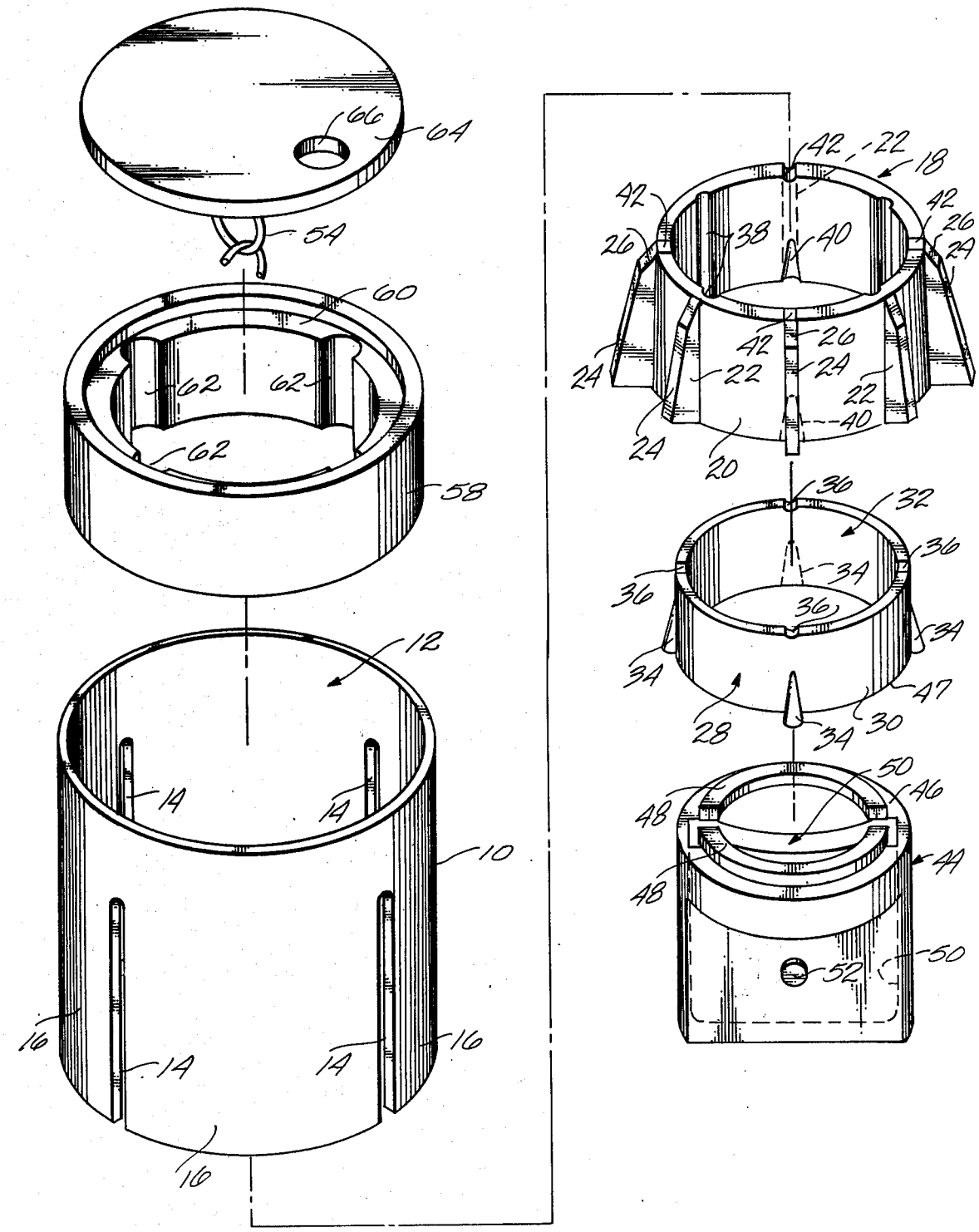
FIG. 1 is an exploded perspective view showing an anchor assembly according to principles of this invention.

Referring to FIG. 1, an anchor assembly according to this invention includes a relatively thin-walled, cylindrical shell 10 which is open at both ends to provide a hollow interior opening 12 extending axially through the shell. A number of circumferentially spaced apart, parallel, elongated grooves 14 extend through the wall of the shell. The grooves 14 extend longitudinally from one end of the shell for a major length of the shell. Preferably, there are four of the grooves 14, and they are spaced equidistantly apart around the shell to form four circumferentially spaced apart segments 16 of identical size. The shell is preferably made of metal tubing which makes the segments 16 relatively deformable so that the segments can be expanded radially outwardly in response to a radially outward force from the interior of the shell.

Figure 3:
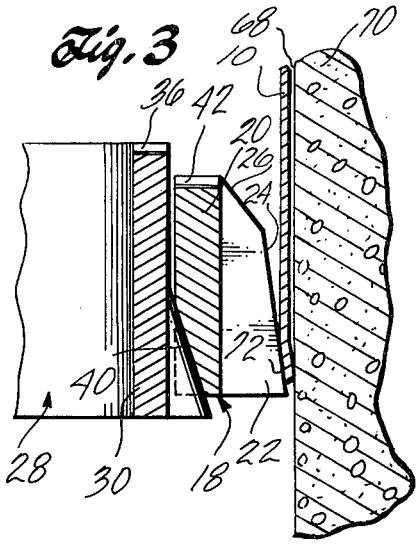
FIG. 3 is an enlarged fragmentary cross-sectional elevation view taken on line 3—3 of FIG. 2.

A ring-like outer wedge 18 has a cylindrical-shaped body 20 which can be tapered to provide a frusto-conical shaped outer wedging surface; but preferably, the body 20 is substantially cylindrical (rather than conical-shaped) and has a number of circumferentially spaced apart, wedge-shaped projections 22 extending around its outer surface. The outside diameter of the body 20 is less than the inside diameter of the shell 10. Preferably, there are eight of the projections 22 spaced equidistantly apart around the body 20 of the wedge member 18. The projections 22 preferably extend longitudinally for the full length of the body 20. The projections 22 have narrow, elongated, rectangular-shaped flat wedge surfaces 24 extending upwardly on an angle, and when viewed from the side (as in FIG. 3), the wedge surfaces 24 taper narrower from the bottom to the top of the outer wedge 18. The projections 22 extend generally parallel to the longitudinal axis of the outer wedge. Each projection 22 preferably has a flat, angled top surface 26 at the narrow end of the taper. The diametrical distance between the outer wedge surfaces 24 of opposing projections 22 varies from slightly less than the inside diameter of the shell 10, at the top ends of the tapers, to slightly greater than the inside diameter of the shell at the bottom ends of the tapers. This allows the wedge surfaces 24 to engage the inside surface of the shell 10 and apply an outward force tending to expand the segments 16 of the shell outwardly when the outer wedge 18 is forced axially upwardly into the bottom of the shell.

The remaining structure of the outer wedge 18 will be described below.

A ring-shaped inner wedge 28 has a cylindrical body 30 which is open at both ends to provide a hollow interior opening 32 extending axially through the inner wedge 28. The outside diameter of the body 30 is less than the inside diameter of the outer wedge body 20. A number of circumferentially spaced apart, wedge-shaped projections 34 are formed around the outer surface of the body 30. The projections 34 preferably have rounded outer wedging surfaces, and they preferably taper narrower from the bottom to the top (as viewed in FIG. 1) of the body 30. Preferably, there are four of the projections 34 equidistantly spaced apart around the body 30; and the projections extend upwardly from the bottom of the force-applying member about one-half the axial length of the member. Preferably, the projections 34 are generally parallel to the longitudinal axis of the body 30. Four circumferentially spaced apart indexing depressions 36 are formed in the top edge of the body 30 at locations aligned longitudinally with the axes of the respective projections 34.

Referring again to the outer wedge 18, the relative diameters of the bodies 20 and 30 would normally allow the inner wedge 28 to slide axially through the hollow interior of the outer wedge 18, but for the projections 34 which block such passage. A number of circumferentially spaced apart and axially extending grooves 38 are formed in the inside surface of the outer wedge body 20. There is one groove 38 for each projection 34 on the force-applying member; and the grooves 38 are aligned axially with the projections 34 so that the inner wedge 28 can be rotated about its axis relative to the outer wedge 18 to a position which allows the projections 34 to be aligned with the grooves 38. In this orientation, the projections 34 can extend into the grooves 38. The grooves 38 are semi-circular shaped and are of such a size that the projections 34 slide axially through the length of the grooves 38. This allows the inner wedge to be slipped axially through the central opening in the outer wedge whenever the projections 34 are aligned axially with the grooves 38.

A number of circumferentially spaced apart tapered depressions 40 are formed on the inside surface of the outer wedge 18. The depressions 40 are shaped to match the contour of the rounded, upwardly and inwardly tapered outer surfaces of the projections 34 on the inner wedge 28. There is one tapered depression 40 for each projection 34, and the depressions 40 are aligned axially with the projections 34. Axial rotation of the inner wedge 28 relative to the outer wedge 18 will align the projections 34 so they can be tightly seated against the depressions 40 when the inner wedge 28 is extended upwardly into the bottom of the opening in the outer wedge. A number of circumferentially spaced apart indexing depressions 42 are formed in the top edge of the outer wedge 18 in axial alignment with the wedge-shaped depressions 40.

Thus, the inner wedge 28 can be rotated about its axis between (1) a first position in which the projections 34 are seated against the depressions 40, which prevents further axial movement of the force-applying member through the outer wedge, and (2) a second position in which the projections 34 are aligned with the grooves 38 so that the inner wedge can be slipped axially through the opening in the outer wedge.

Figure 2:
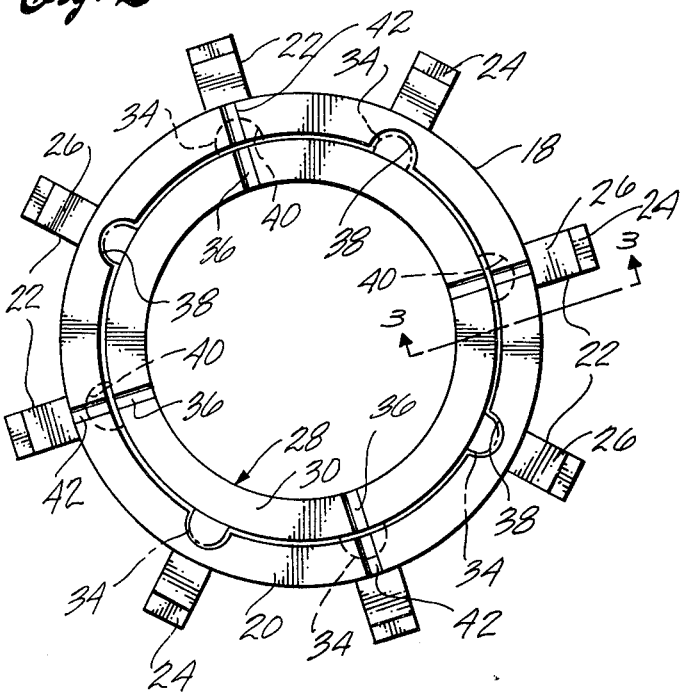
FIG. 2 is a top plan view showing an inner wedge engaged with an outer wedge of the an anchor assembly.

FIG. 2 shows the inner wedge rotated axially to the first position in which the projections 34 bear against the tapered depressions 40 in the outer wedge 18. FIG. 2 also shows the projections 34 in phantom lines when the inner wedge 28 is rotated axially to the second position allowing the projections to slide longitudinally through the grooves 38 in the outer wedge 18. The indexing depressions 36 and 42 provide a means for indicating when the inner wedge 28 is rotated to the first position. When the inner wedge 28 is rotated to align the indexing depressions 36 radially with the depressions 42, then the tapered projections 34 (which cannot be seen from above during use) are automatically in position for being seated against the tapered depressions 40 of the outer wedge 18.

Referring again to FIG. 1, the anchor assembly further includes a generally inverted bell-shaped cable-attachment member 44 having a ring-shaped upper portion with a circular top edge 46 for bearing against a lower circular edge 47 extending around the bottom of the inner wedge body 30. The maximum outside dimension of the cable-attachment member 44 is less than the inside diameter of the outer wedge body 20. A pair of circularly-shaped projections 48 extend upwardly above the bearing surface 46 of the cable-attachment member 44. The projections 48 provide a means for releasably interlocking the cable-attachment member 44 in the bottom of the inner wedge so they will not slip laterally relative to one another. This holds the bearing surface 46 of the cable-attachment member in contact with the bottom edge 47 of the inner wedge 28 during use of the anchor.

A hollowed-out recess 50 is formed in the central portion of the cable-attachment member 44 between the projections 48. The recess 50 opens upwardly toward the inner wedge when the cable-attachment member 44 is seated in the bottom of the inner wedge 28. A transverse pin 52 is rigidly affixed in the bottom portion of the cable-attachment member 44. The pin 52 bridges the recess 50 to provide a means for rigidly attaching the bottom of a short length of chain 54 (shown in FIGS. 4 and 5) in a fixed position in the recess 50.

Figure 4:
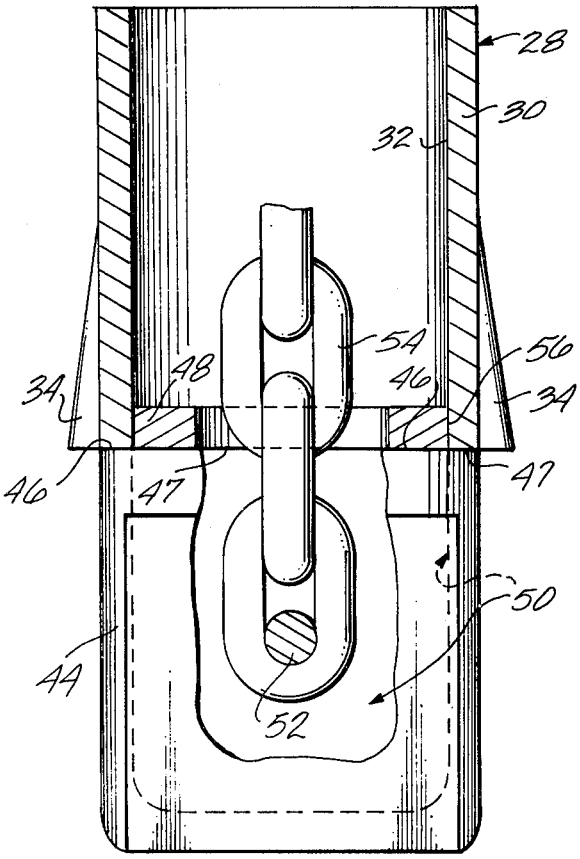
FIG. 4 is a fragmentary side elevation view, partly in cross-section and partly broken away, showing a cable-attachment member engaged with the inner wedge of the anchor assembly.
Figure 5:
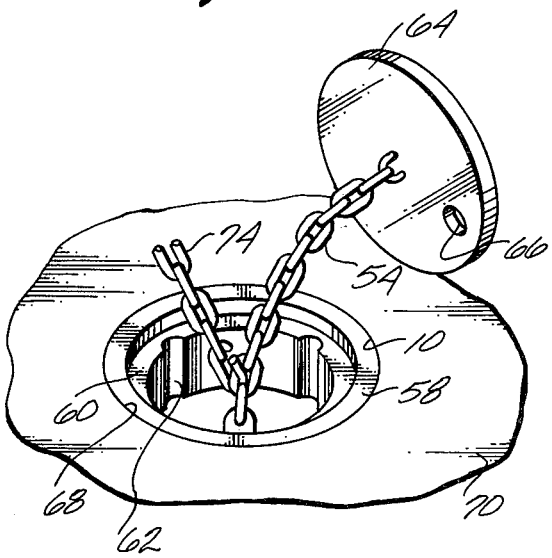
FIG. 5 is a fragmentary perspective view illustrating a use of the anchor assembly.
Figure 6:
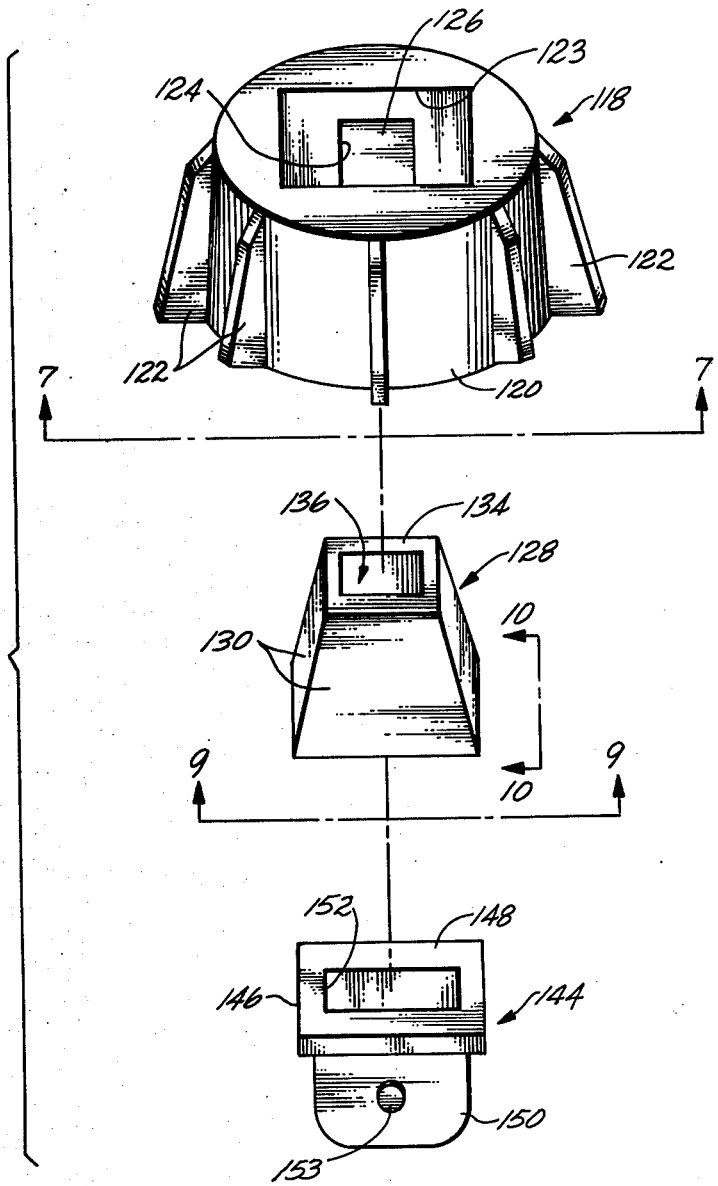
FIG. 6 is an exploded perspective view showing a portion of an alternate embodiment of the anchor assembly.

FIG. 4 best illustrates the cable-attachment member 44 during use, in which the projections 48 are fitted into the bottom interior opening in the inner wedge 28 so that peripheral edges 56 of the projections 48 releasably engage the inside surface 32 of the inner edge 28. This locates the cable-attachment member 44 relative to the inner wedge 28 so that their bearing surfaces 46 and 47 are held against one another in response to an upward tensioning force applied to the chain 54.

Referring again to FIG. 1, the anchor assembly also includes an open-ended reinforcing ring 58. A recessed circular shoulder 60 extends around an upper interior portion of the ring 58. A number of circumferentially spaced apart, longitudinally extending grooves 62 are formed on the inside surface of the reinforcing ring. There are preferably four of the grooves 62, and these grooves are aligned axially with the grooves 38 in the outer wedge 18. The grooves 62 extend from the shoulder 60 to the bottom edge of the reinforcing ring and provide a means for allowing the inner wedge 28 and the cable-attachment member 44 to be slipped axially through the opening in the reinforcing ring, when the grooves in the reinforcing ring are aligned axially with the grooves in the outer wedge.

A circular top cover plate 64 rests on the shoulder 60 of the reinforcing ring 58. The short length of chain 54 is rigidly affixed to the underside of the top cover plate 64. A hole 66 in the top cover plate provides means for lifting the cover plate into or out of the recessed opening in the top of the reinforcing ring. When the top cover plate is closed, the chain 54 is held inside the enclosed anchor assembly. The short chain 54 is used to hold a cable, chain or the like, anchored to the anchor assembly, as described in more detail below.

The anchor assembly is used by initially forming a cylindrical-shaped hole 68 (shown in FIGS. 3 and 5) in a base material 70 such as a concrete floor. The diameter of the hole 68 is just sufficient to allow clearance for the outer shell 10. After the hole 68 has been formed, the outer shell 10 is fitted into the hole, and the outer wedge 18, the inner wedge 28, and the cable-attachment member 44 are then assembled inside the shell in the relative positions shown in FIG. 1. That is, the cable-attachment member 44 is fitted into the bottom opening of the inner wedge 28, and the top of the inner wedge 28 is fitted into the bottom of the outer wedge 18, with the inner wedge 28 being rotated to its first position (described above) so that the tapered projections 34 are seated on the tapered depressions 40 of the outer wedge 18. The top of the outer wedge 18 is inserted into the bottom opening of the shell 10.

Once these elements are assembled, a hydraulic pulling apparatus (not shown, but described in my U.S. Pat. No. 3,494,587) is then positioned over the hole 68 and attached to the chain 54 to apply tension to the chain to draw the outer wedge 18 upwardly into the interior of the shell 10. The upward tension force applied to the chain 54 forces the inner wedge 28 upwardly against the inside surface of the outer wedge 18 to pull the outer wedge upwardly. This causes the projections 22 of the outer wedge 18 to apply a wedging force to the inside of the shell 10. This forceably expands the segments 16 to the shell 10 radially outwardly to embed the shell in the hole 68. The shell outer wall is actually forceably expanded by cold forming of wide parallel grooves in the inside surface of the shell by the flat wedge surfaces 24 of the projections 22 being forced upwardly into contact with the shell. The outer wedge 18, the inner wedge 28, and cable-attachment member 44 are all made from cast steel having a structural strength sufficient such that they do not deform when the large pulling force is applied to the chain 54. The shell 10, on the other hand, is made of a relatively thin-walled steel tubing which deforms under the applied load.

Once the shell is embedded in the floor, the reinforcing ring 58 is inserted into the top of the shell and oriented so that the grooves 62 are aligned axially with the respective grooves 38 of the outer wedge. The reinforcing ring 58 is then welded in place in the shell. The top cover plate 64 then can be placed in the recessed opening in the top of the reinforcing ring 58, with the short length of chain 54 being housed within the enclosed anchor assembly.

The anchor assembly is used by removing the cover plate 64 to expose the chain 54. A chain 74 (see FIG. 5), or other flexible cable means, then can be attached to the chain 54 and tensioned against the resistance provided by the embedded anchor assembly. At any time it is desired to remove the chain 54, the inner wedge 28 is simply tapped downwardly to release it from its frictionally seated position against the outer wedge 18. The inner wedge is then rotated to its second position (described above) to align its projections 34 with the grooves 38 and 62 of the outer wedge 18 and reinforcing ring 58, respectively. The inner wedge 28, together with the cable-attachment device 44 and chain 54, then can be slipped axially through openings in the outer wedge and the reinforcing ring.

The anchor assembly thus avoids the problems of the chain 54 rusting out or breaking during use, because the chain can be easily removed from the shell for replacement. In addition, the ability to easily remove the chain, the inner wedge, and the cable-attachment device makes it possible to frequently clean out the shell and thereby avoid large accumulations of dirt or other corrosive matter in the shell. Since the chain 54 can be easily removed from the shell, chains of different weight can be installed in the shell. For example, cable-attachment devices holding different weight chains, such as ½-inch, ⅜-inch or 7/16-inch steel alloy chains can be attached to different cable-attachment members 44, each of which can be interchangeable in the anchor assembly. Thus, separate anchor assemblies are not required for chains of different weight. The top cover plate 64, being recessed to the plane of the floor, avoids any interference with workmen when the anchor is not in use. During use, reinforcing ring 58 prevents the chain 74 from crushing the concrete floor surrounding the anchor.

FIGS. 6 through 10 show an alternate embodiment of the anchor assembly which includes an outer wedge 118, an inner wedge 128, and a cable-attaching member 144. The outer shell 10, the reinforcing ring 58, and the top plate 64 shown in FIG. 1 can be used with the assembly components shown in FIG. 6, but they are not shown in FIG. 6 for simplicity.

The outer wedge 118 is similar to the outer wedge 18 shown in FIG. 1. The outer wedge 118 comprises a rigid cylindrical body 120 having circumferentially spaced apart tapered outer projections 122 which are identical in shape and orientation to the tapered projections 22 of the outer wedge 18 described above. A narrow rectangular-shaped opening 123 extends centrally from top to bottom through the cylindrical body 120. The length or long dimension of the rectangular opening 123 (represented by D in FIG. 7) extends along a first transverse axis of the cylindrical body. The width or short dimension of the rectangular opening (represented by $d_1$ in FIG. 7) extends along a second transverse axis which is perpendicular to the first transverse axis. A transverse rectangular-shaped slot 124 extends upwardly into the rectangular opening 123. The slot 124 opens through the bottom of the outer wedge and extends centrally through the lower porton of the outer wedge, as illustrated in FIG. 8, terminating in a horizontal interior surface 125 spaced below the top of the outer wedge. The length or long dimension of the slot 124 (shown extending from top to bottom in FIG. 7) extends perpendicularly to the length D of the rectangular opening 123. The slot 124 has outer interior surfaces 126 which taper upwardly and inwardly as shown best in FIG. 8. The width of the slot (represented by dimension $d_2$ in FIG. 7) is essentially equal to the width of the rectangular opening 123 and therefore is substantially equal to the dimension $d_1$.

The inner wedge 128 is shaped as a polyhedron which is rectangular in transverse cross-section and has four sides which taper narrower from bottom to top, forming trapezoidal faces 130 extending from a relatively larger rectangular base 132 to a relatively smaller rectangular top surface 134. The base 132 and the top surface 134 are parallel to one another and each trapezoidal face 130 tapers upwardly and inwardly at about the same angle of inclination. A rectangular-shaped central opening 136 extends from top to bottom through the inner wedge. The base 132 of the inner wedge is sized so that the inner wedge can slip axially through the rectangular opening 123 in the outer wedge when the long dimension of the inner wedge is aligned with the long dimension D of the rectangular opening 123. The outer portions of the rectangular opening 123 provide the equivalent of spaced apart grooves which allow the small inner wedge to pass entirely through the hollow interior of the outer wedge. Thus, the inner wedge, when initially positioned above the outer wedge, can be slipped downwardly through the outer wedge and be positioned below the outer wedge.

When the inner wedge is positioned below the outer wedge, the inner wedge can be rotated on its axis to align the long dimension of the inner wedge wth the long dimension of the rectangular slot 124 in the bottom of the outer wedge. The long dimension of the top surface 134 of the inner wedge is slightly longer than the long dimension of the upper horizontal interior surface 125 of the outer wedge, and the long dimension of the base 132 of the inner wedge is slightly longer than the long dimension of the bottom opening provided by the slot 124. Thus, by only pulling the inner wedge axially upwardly into the bottom of the rectangular slot 124, the opposite wedge-shaped faces 130 of the inner wedge are wedged against the tapered faces 126 of the outer wedge. The wedging force holds the inner wedge in place in the outer wedge, resisting upward tension on a cable engaged with the inner wedge. The wedging force is releasable in that the inner wedge can be removed from the slot 124 simply by a downward blow on the top of the inner wedge. Thus, the inner wedge can be easily slipped into place below the outer wedge, rotated and pulled upwardly to be wedged in the outer wedge, released simply by a downward axial blow, and removed by rotating the inner wedge and slipping it upwardly through the outer wedge. A chain or cable attached to the inner wedge thus can be easily anchored and removed.

The cable-attaching means 144 is similar to the cable-attaching means 44 described above. The cable-attaching means 144 includes a flanged top portion 146 having a rectangular upper bearing surface 148 which is the same size as the rectangular base 132 of the inner wedge. The cable-attaching means also has a cup-shaped bottom portion 150 below the flanged top portion 146. An upwardly facing rectangular-shaped opening 152 extends through the flanged upper portion and down into the cup-shaped bottom portion 150. A transverse pin 153 extends through opposite side walls of the bottom portion 150 so that the pin traverses the opening 152 in the bottom portion 150. A chain, such as the chain 54 described above, is attached to the pin 153 and fits into the opening in the cable-attaching means.

In use, a chain attached to the pin 153 can be slipped through the opening 123 in the outer wedge along with the inner wedge and the cable-attaching means 144. Thereafter, upward tension on a cable attached to the chain forces the bearing surface 148 of the cable-attaching means 144 against the base 132 of the inner wedge and is used to apply an upward force on the inner wedge to releasably wedge the inner wedge in the rectangular slot 124 in the outer wedge.

I claim:

1. Anchor apparatus for being installed in an opening in a floor to anchor a cable in said opening, the anchor apparatus comprising:

a hollow outer shell having an expandable wall;

a hollow outer wedge having a side wall extending between a top edge and a bottom edge of the outer wedge, the side wall having a wedge-shaped outer surface for being disposed in the outer shell to engage the expandable wall of the outer shell;

an inner wedge having a side wall extending between a top edge and a bottom edge of the inner wedge, the side wall of the inner wedge having an outer surface which tapers wider, away from an axis of the inner wedge, from the top edge toward the bottom edge of the inner wedge so that the widest portion of the tapered outer surface is adjacent the bottom edge of the inner wedge, the inner wedge being rotatable axially between a first position and a second position;

the outer wedge having an interior surface having a first interior surface portion and a second interior surface portion, the first interior surface portion tapering wider, away from an axis of the outer wedge, so that the widest portion of the tapered first interior surface portion is adjacent the bottom edge of the outer wedge, the tapered outer surface portion of the inner wedge, in said first position, engaging the tapered first interior surface portion of the outer wedge; and means for being attached to a cable for use in urging the tapered outer surface of the inner wedge, in said first position, into engagement with the tapered first interior surface portion of the outer wedge in response to an upward force on the cable for forcibly wedging the tapered outer surface of the inner wedge against the tapered first interior surface of the outer wedge and for causing the wedge-shaped outer surface of the outer wedge to engage and forcibly expand the expandable wall of the outer shell;

the second interior surface portion of the outer wedge being shaped to allow passage of said inner wedge and said cable-attaching means axially through the hollow interior of the outer wedge, when the inner wedge is rotated to said second position, so that rotation of the inner wedge to said first position will position the tapered outer surface portion of the inner wedge for wedging engagement with the tapered first interior surface portion of the outer wedge.

2. Apparatus according to claim 1 in which the cable-attaching means comprises a force-applying member which is separable from the inner wedge and has a bearing surface for releasably engaging a cooperating bearing surface on the bottom edge of the inner wedge, the force-applying member being freely rotatable relative to said bearing surface; and in which the cable-attaching means further includes a fixed support secured to the force-applying member for attachment to the end of a cable.

3. Apparatus according to claim 1 in which the outer wedge comprises a rigid body having circumferentially spaced apart tapered outer surface projections for being forcibly wedged into engagement with the side wall of the outer shell in response to.the tapered outer surface of the inner wedge being forcibly wedged against the tapered first interior surface portion of the outer wedge.

4. Apparatus according to claim 3 in which the outer shell has circumferentially spaced apart expandable segments, and in which the tapered projections of the outer wedge are engageable with the expandable segments to allow said projections to cold form axial grooves inside the segments and force the segments radially outwardly against a floor in which the shell is disposed to embed the shell in the floor.

5. Apparatus according to claim 1 in which the tapered outer surface of the inner wedge comprises a plurality of tapered surfaces circumferentially spaced apart around the side wall of the inner wedge, and in which the first interior surface portion of the outer wedge comprises a plurality of tapered surfaces circumferentially spaced apart around the side wall of the outer wedge, each tapered surface of the outer wedge being shaped to engage and laterally confine a corresponding tapered surface of the inner wedge to inhibit rotation of the inner wedge relative to the outer wedge.

6. Apparatus according to claim 5 in which the second interior surface portion of the outer wedge comprises a plurality of separate groove-like portions circumferentially spaced apart around the interior surface of the outer wedge side wall, and in which the tapered surfaces of the inner wedge can slide longitudinally along the surface and through said spaced apart groove-like portions when the inner wedge is in said second position.

7. Apparatus according to claim 6 in which the cable-attaching means includes a fixed support for attachment to an end of a cable, and a bearing surface for engagement with a cooperating bearing surface on the bottom edge of the inner wedge.

8. Anchor apparatus for being installed in an opening in a floor to anchor a cable in said opening, the anchor apparatus comprising:

a hollow outer shell having an expandable wall;

a hollow outer wedge having a side wall having an interior surface and a wedge-shaped outer surface for being disposed in the outer shell to engage the expandable wall of the outer shell;

said interior surface having mutually spaced apart first surface portions;

an inner wedge having mutually spaced apart wedge-shaped outer surface portions spaced to engage the spaced apart first surface portions of the outer wedge interior surface, the inner wedge being rotatable axially between a first position and a second position;

the interior surface of the outer wedge having mutually spaced apart second surface portions, the wedge-shaped outer surface portions of the inner wedge, in said first position, engaging the first surface portions of the outer wedge;

means for being attached to a cable extending through the shell for use in urging the wedge-shaped outer surface portions of the inner wedge, in said first position, into engagement with the first surface portions of the outer wedge interior surface so that the wedge-shaped outer surface of the outer wedge engages and forcibly expands the expandable wall of the shell;

the second surface portions of the outer wedge interior surface being shaped to allow the wedge-shaped outer surface portions of the inner wedge to slide along the surface of and through the second surface portions of the outer wedge, when the inner wedge is rotated to said second position, so that rotation of the inner wedge to said first position will position the wedge-shaped outer surface portions of the inner wedge for engagement with the first surface portions of the outer wedge; and a reinforcing member for being disposed in a top portion of the outer shell on the side of the outer wedge opposite to the inner wedge, the reinforcing member having a hollow interior having spaced apart surface portions for being aligned axially with the second surface portions of the outer wedge for allowing passage of the inner wedge through the hollow interior of the reinforcing member.

9. Apparatus according to claim 8 including a top cover for removably resting on a shoulder inside a top portion of the reinforcing member.

10. Anchor apparatus for being installed in an opening in a floor to anchor a cable in said opening, the anchor apparatus comprising:

a hollow outer shell having an expandable wall;

a hollow outer wedge having a side wall having an interior surface having circumferentially space apart first surface portions and a wedge-shaped outer surface for being disposed in the outer shell to engage the expandable wall of the outer shell;

an inner wedge having circumferentially spaced apart tapered projections on the outer surface thereof shaped to engage the spaced apart first surface portions of the outer wedge interior surface, the inner wedge being rotatable axially between a first position and a second position;

the interior surface of the outer wedge having circumferentially spaced apart grooves, the tapered projections of the inner wedge, in said first position, engaging the first surface portions of the outer wedge;

means for being attached to a cable extending through the outer shell for use in urging the tapered projections of the inner wedge, in said first position, into engagement with the first surface portions of the outer wedge interior surface for wedging the inner wedge inside the outer wedge and causing the wedge-shaped outer surface of the outer wedge to engage the expandable wall of the shell and forcibly expand the wall of the shell;

the grooves of the outer wedge interior surface being shaped to allow the spaced apart projections of the inner wedge and said cable-attaching means to slide longitudinally through the grooves, when the inner wedge is rotated to said second position, so that rotation of the inner wedge to said first position will position the tapered projections of the inner wedge for engagement with the first surface portions of the outer wedge; and a reinforcing member for being disposed in a top portion of the outer shell on a side of the outer wedge opposite the inner wedge, the reinforcing member having a hollow interior having circumferentially spaced apart, longitudinally extending grooves aligned axially with the grooves of said outer wedge for allowing passage of the inner wedge through the hollow interior of the reinforcing member.

* * * * *